US006082839A

United States Patent [19]

Chiku

[11] Patent Number: 6,082,839

[45] Date of Patent: Jul. 4, 2000

[54] DRAWER CONTROL FOR OFFICE CABINETS

[75] Inventor: Kiyoshi Chiku, Tokyo, Japan

[73] Assignee: Inaba Saisakusho Co., Ltd, Tokyo, Japan

[21] Appl. No.: 09/016,019

[22] Filed: Jan. 30, 1998

[30] Foreign Application Priority Data

Jun. 12, 1997 [JP] Japan ..... 9-154666

[51] Int. Cl.[7] ..... E05B 65/46; E05C 7/06

[52] U.S. Cl. ..... 312/219; 312/217

[58] Field of Search ..... 312/219, 221, 312/222, 217

[56] References Cited

U.S. PATENT DOCUMENTS

| | | | |
|---|---|---|---|
| 3,881,793 | 5/1975 | Anderson | 312/217 |
| 4,303,287 | 12/1981 | Taplin | 312/221 X |
| 4,854,653 | 8/1989 | Lakso | 312/222 |
| 4,957,334 | 9/1990 | Lakso | 312/219 X |
| 4,966,423 | 10/1990 | Higuera et al. | 312/219 X |
| 5,040,858 | 8/1991 | Kruse et al. | 312/221 |
| 5,176,436 | 1/1993 | Mitchell | 312/217 X |
| 5,427,445 | 6/1995 | Mitchell | 312/217 X |
| 5,599,078 | 2/1997 | Dechene et al. | 312/221 |
| 5,702,167 | 12/1997 | Muller | 312/217 X |
| 5,782,545 | 7/1998 | Kahara et al. | 312/217 |

FOREIGN PATENT DOCUMENTS 3008337 8/1994 Japan .

*Primary Examiner*—Peter M. Cuomo
*Assistant Examiner*—David E. Allred
*Attorney, Agent, or Firm*—Marger Johnson & McCollom, PC

[57] ABSTRACT

In a drawer control for a file cabinet, a latch member is adapted to rotate via a striker pin attached to the drawer from a release position to an engagement position when the drawer is about to be fully closed. The latch member is urged by a reversing spring which opposes the closing of a drawer until a neutral position adjacent to a fully closed position is reached, and once this neutral position is passed, the reversing spring assists the closing of the drawer to thereby provide a damping action to the drawer movement. Additionally, a moveable member extending across the latch members of the respective drawers can be moved by a cylinder lock so as to engage all the latch members to centrally lock all the drawers, and the moveable member is similarly actuated by opening of one of the drawers so as to interlock the movements of the drawers and permit only one of the drawers to be opened at a time.

13 Claims, 6 Drawing Sheets

DRAWER CONTROL FOR OFFICE CABINETS

TECHNICAL FIELD

The present invention generally relates to office cabinets and other forms of office furniture having a plurality of vertically stacked drawers, and in particular to drawer control for such office furniture for controlling the movement of the drawers thereof.

BACKGROUND OF THE INVENTION

In filing cabinets, each drawer is typically guided by a pair of guide rails secured to either side of the drawer via rollers or slide shoes attached to the inner sides of the side panels of the cabinet main body. In addition to such means for guiding the in-and-out movement of the drawer, filing cabinets are typically equipped with a drawer control which allows the drawer to be selectively locked up among other possible functions. For security reasons, all the drawers are required to be locked up with a single operation. The drawer movement may be interlocked in such a manner that only one drawer can be pulled out at a time. Thereby, the need for massive counterweights to balance the shifting of the mass of the drawer can be eliminated. Additionally, a certain damping action is desirable which prevents the drawer to be inadvertently pulled out from the impact of the fully closing the drawer or from other impacts and vibrations, and absorbs the impact of the fully closing of the drawer.

Conventionally, there have been a number of proposals to achieve such functions, but as they were each directed to achieve only one or two of such functions. Therefore, when all of these functions are to be incorporated into a single cabinet, they had to be installed separately, and were inevitably complex and costly. For instance, Japanese utility model registration publication No. 3,008,337 discloses an arrangement which incorporates both a total lock up mechanism and a drawer interlock mechanism into a single mechanism.

A drawer damping mechanism can be achieved by providing a reversing spring mechanism including a resiliently supported catch which resiliently opposes the closing of the drawer immediately before it is fully closed, but resiliently pulls in the drawer when the drawer continues to move in the closing direction beyond a certain dead point. Once the drawer is fully closed, the resilient catch prevents the pulling out of the drawer unless a force greater than the resilient force acting on the catch is applied to the drawer. When the drawer is pulled out from the fully closed state with a sufficient force, the resilient catch is forced to move past the dead point, and, once this dead point is passed, assists the pulling out of the drawer. This drawer damping mechanism can therefore prevent an inadvertent opening of the drawer even when the drawer is forcibly closed, or when impacts and vibrations from other sources are applied to the drawer in addition to absorbing the impact of fully closing the drawer.

However, when the three functions are performed by two or more individual mechanisms, a substantially large number of component parts are required, and the amount of the assembly work correspondingly increases. These factors all contribute to the increase in the cost. Furthermore, because these three functions are required to be properly synchronized in operation, an inadequate assembling precision in one of the mechanisms may cause a general failure of the drawer movement.

BRIEF SUMMARY OF THE INVENTION

In view of such problems of the prior art, a primary object of the present invention is to provide an improved drawer control for office cabinets which incorporates a drawer lock up mechanism, a drawer interlock mechanism, and a drawer damping mechanism into a single mechanism.

A second object of the present invention is to provide a drawer control for office cabinets which is convenient and reliable in use, and economical to manufacture.

A third object of the present invention is to provide a drawer control for office cabinets which is convenient and reliable in use, and easy to assemble.

According to the present invention, these and other objects can be accomplished by providing a drawer control for a file cabinet which includes a cabinet main body, and a plurality of vertically stacked drawers, the drawer control comprising: a striker pin secured to each of the drawers; a latch member pivotally attached to an inner surface of the cabinet main body and including a latch slot adapted to receive the striker pin, the latch member being pivotable between an engagement position for engaging the striker pin in the latch slot when the drawer is adjacent to a fully closed position thereof, and a release position for receiving and releasing the striker pin in and from the latch slot when the drawer is some distance away from the fully closed position thereof; a latch spring which urges the latch member toward the engagement position when the latch member is between the engagement position and an intermediate neutral position, and toward the release position when the latch member is between the intermediate neutral position and the release position; a moveable member extending across the latch members of the respective drawers, and moveable between a lock position for locking the latch member at the engagement position, and an unlock position for permitting movement of the latch member from the engagement position to the release position; and a lock member which moves the moveable member between the lock position and the unlock position for selectively and simultaneously locking all of the drawers; the latch member being provided with an actuating portion which moves the moveable member from the unlock position to the lock position when the latch member has pivoted from the engagement position to the release position so as to allow only one of the drawers to be opened at a time.

Thus, the latch member is commonly used for performing the functions of locking all the drawers, interlocking the drawer movement, and providing a damping action. As the drawer moves toward the fully closed position, the striker pin secured to the drawer moves into the latch slot of the latch member, and then forces the latch member to turn from the release position to the engagement position. The latch spring initially opposes the inward movement of the drawer, but once a certain neutral point is passed, the latch spring resiliently assists the inward movement of the drawer. Thus, the impact of fully closing the drawer is resiliently absorbed, and once the drawer is fully closed, the drawer is resiliently retained at its fully closed position even when subjected to impacts and vibrations.

When the moveable member is moved to the lock position, the latch members for all the drawers are prevented from turning so that all the drawers can be simultaneously locked up. When any one of the drawer is pulled put, the resulting turning movement of the corresponding latch member forces the moveable member from the unlock position to the lock position so that only one of the drawers is allowed to be pulled out at a time.

The selective engagement of each of the latch members can be easily achieved by receiving a laterally extending pin in a control slot provided in the moveable member. The slot may, for instance, consist of an L-shaped slot so that a vertical leg thereof may be used for locking the latch member, and a horizontal leg thereof may be used for actuating the moveable member from the unlock position to the lock position for interlocking of the drawers. This arrangement also contributes to the simplification of the arrangement. Based on this appreciation, the moveable member may be provided with a control slot for each of the latch members, the control slot being provided with a first leg and a second leg, and each of the latch members is provided with a laterally extending pin which is received in a corresponding one of the control slots, the laterally extending pin being engaged by the first leg of the control slot so as to prevent movement of the latch member when the moveable member is at the lock position. Additionally, the laterally extending pin may be adapted to move along the second leg of the control slot as the latch member pivots from the engagement position to the release position and the laterally extending pin moves along an arcuate path so as to move the moveable member into the lock position. Preferably, the control slot consists of an L-shaped slot, and the first and second legs are defined by vertical and horizontal legs of the L-shaped slot.

The arrangement of the latch spring is important for compact design and reliable operation. Therefore, according to a preferred embodiment of the present invention, the latch spring includes a pair of legs which are pivotally attached to a fixed part and a part of the latch member so as to apply a biasing force which tends to move the two legs away from each other. The spring may be made of a planar sheet spring cut into a prescribed shape, such as a shape of letter Ω. The spring may consist of inexpensive and durable material such as plastics.

In such an arrangement, the spring is required to be installed in a pre-stressed state. To facilitate the assembly work, the latch member may be provided with an arcuate recess for resiliently interposing the latch spring between a point of pivotal attachment of the latch spring to the latch member and the arcuate recess for retaining the latch spring onto the latch member when pivotally attaching both the latch member and the latch spring to the fixed part.

BRIEF DESCRIPTION OF THE DRAWINGS

Now the present invention is described in the following with reference the appended drawings, in which.

DETAILED DESCRIPTION OF THE PREFERRED EMBODIMENTS

Figure 1:
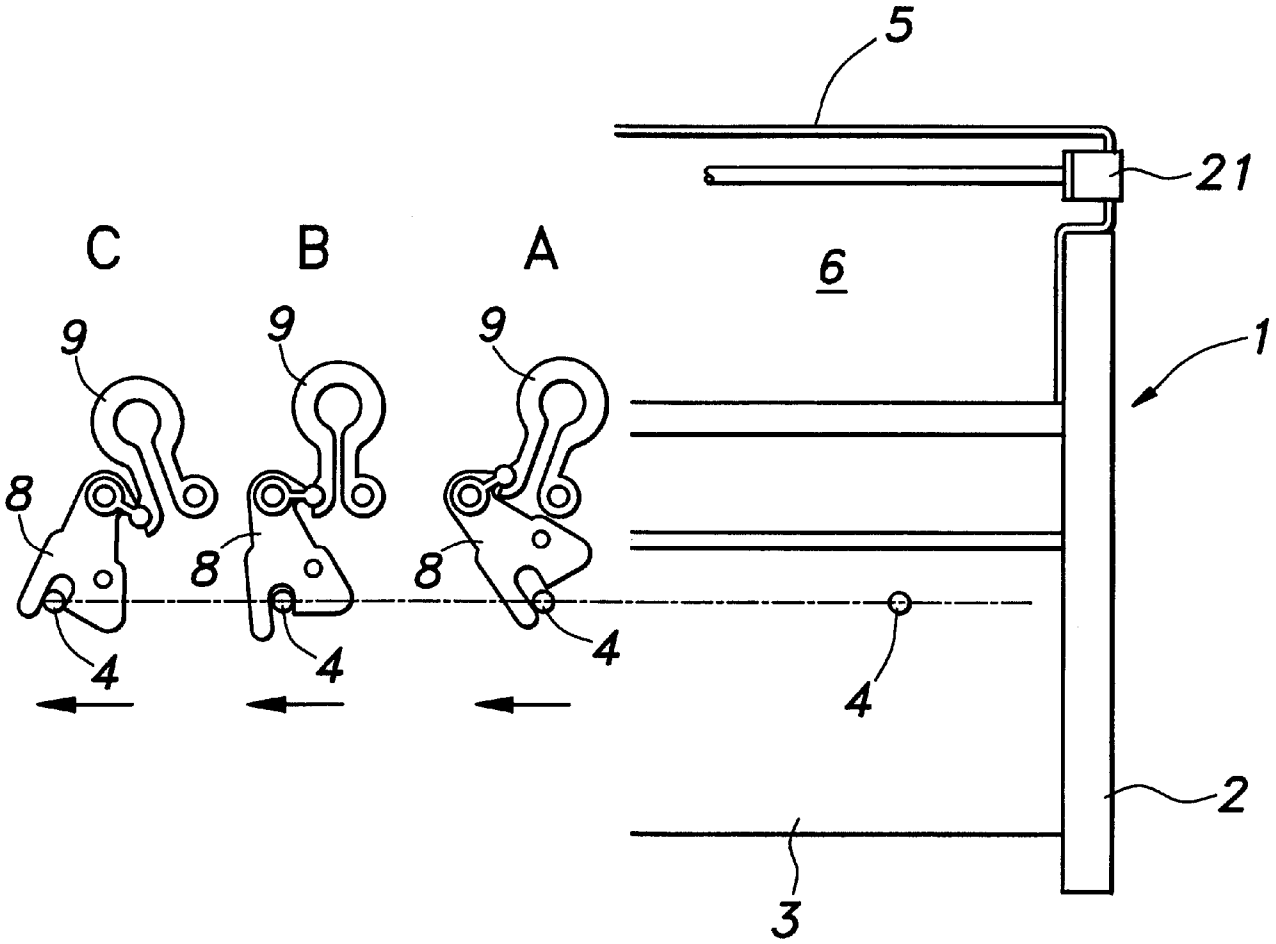
FIG. 1 is a schematic view showing the relationship between the latch member and the latch spring embodying the present invention in three different positions.
Figure 2:
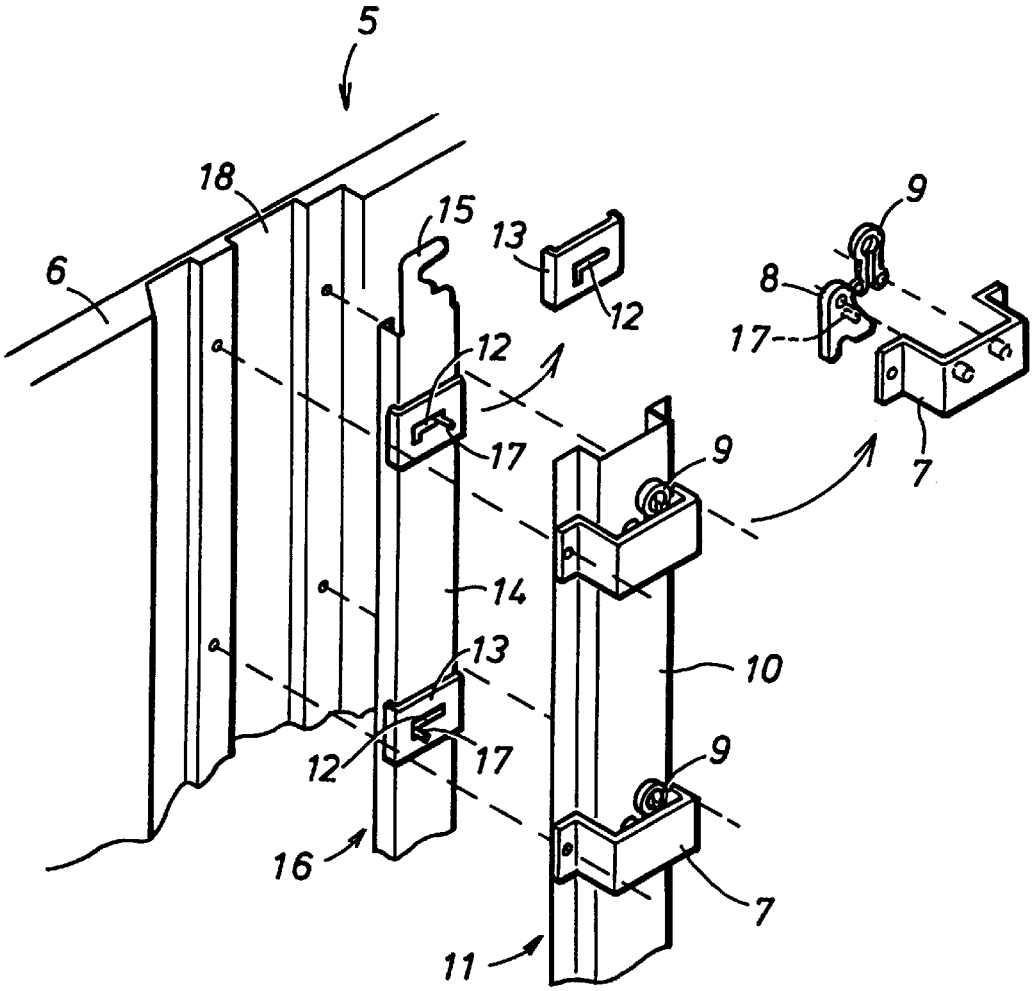
FIG. 2 is a fragmentary exploded perspective view showing the an essential part of the embodiment.

Referring to FIG. 1, an office cabinet embodying the present invention includes a plurality of vertically stacked drawers 1, and each drawer comprises a front panel 2, and a striker pin 4 projecting from each side of a drawer main body 3. A control mechanism is provided on the inner surface of each side panel 6 of a cabinet main body 5, the control mechanism including a latch mechanism which is adapted to be actuated by the corresponding striker pin 4. The drawer 1 is guided by a pair guide rails mounted to the inner side of either side panel 6 of the cabinet main body 5, and corresponding sliders mounted to either side of the drawer main body 3. As this drawer guide arrangement is by itself conventional, and is therefore not described in the present application.

The latch mechanism comprises a latch member 8 pivotally mounted to a fixed member 11, and a slot plate 13 mounted to a moveable member 16, as described in more detail hereinafter. The latch member 8 which in this case is made of a planar metallic member is provided with a latch slot 31 for engaging the striker pin 4 of the drawer 1. The latch member 8 is engaged by a reversing spring which consists of an Ω-shaped latch spring 9 in this embodiment in such a manner that the latch spring 9 opposes the inward movement of the drawer 1 as the striker pin 4 is engaged by the slot 31 (FIG. 1A) until a critical point (FIG. 1B) is reached, and starts assisting the inward movement of the drawer 1 once this critical point is passed (FIG. 1C). Thus, when the drawer 1 is pushed inward all the way or, in other words, fully closed, the latch spring 9 tends to keep the drawer 1 shut even when vibrations, impacts or other external forces are applied as long as the resulting force does not exceed the biasing force of the latch spring 9. Conversely, when the drawer 1 is pulled out with a sufficient force, the striker pin 4 causes the latch member 8 to turn against the biasing force of the latch spring 9. The spring force of the latch spring 9 initially resists the outward movement of the drawer, but, again, once the critical point is passed, the biasing force of the latch spring 9 starts assisting the outward movement of the drawer 1.

The control mechanism additionally comprises a latch mounting plate 7 which is secured to the fixed member 11 at a level matching with the striker pin 4 of the drawer 1. The latch mounting plate 7 carries thereon the latch member 8 and the latch spring 9. The fixed member 11 consists of a channel member which defines a vertical passage in cooperation with a groove 18 defined in the inner surface of the side panel 6. The vertically elongated moveable member 14 is received in this vertical passage. A slot plate 13 having an L-shaped control slot 12 is attached to the moveable member 14, and a hook 15 is formed at the upper end of the moveable member 14. Thus, the moveable member 14 is allowed to move vertically in the groove 18, covered by the fixed member 11.

The latch member 8 is provided with a laterally projecting pin 17 at a point offset from a pivot shaft 29 of the latch member 8. The pin 17 is passed through an opening (not shown in the drawing) provided in the fixed member 11, and is received in the L-shaped control slot 12 of the slot plate 13. The opening in the fixed member 11 has a sufficient opening area not to interfere with the movement of the pin 17, and may consist of an arcuate slot so as to minimize the opening area without interfering with the movement of the pin 17. Thus, the moveable member 14 is suspended in the groove 18 by the pins 17 projecting from the latch plates 8 of the respective drawers 1 and fitted into the corresponding control slots 12. The hook portion 15 at the upper end of the moveable member 14 is engaged by a cranked free end 20 of a crankshaft 24 of a lifting mechanism 19 as best illustrated in FIG. 3.

The lifting mechanism 19 comprises a key cylinder 21 which may be provided on the front side of the cabinet and can be turned by using a matching key, a drive shaft 22 extending in the direction of the movement of the drawer, and rotatably supported by a bearing block 28*a,* and a coupling member 27 including a tubular boss 25 receiving a cranked free end of the drive shaft 22 and a sleeve portion 26 having a U-shaped cross section. The crankshaft 24 additionally comprises a cranked intermediate part 23, and the sleeve portion 26 receives the cranked intermediate part 23. A part of the crankshaft 24 adjacent to the cranked intermediate part 23 is rotatably supported by a bearing block 28*b.* It should be noted that the crankshaft 24 extends laterally inside the cabinet in a symmetric arrangement about the drive shaft 22, and that FIG. 3 shows only the right end portion of the crankshaft 24.

Figure 3:
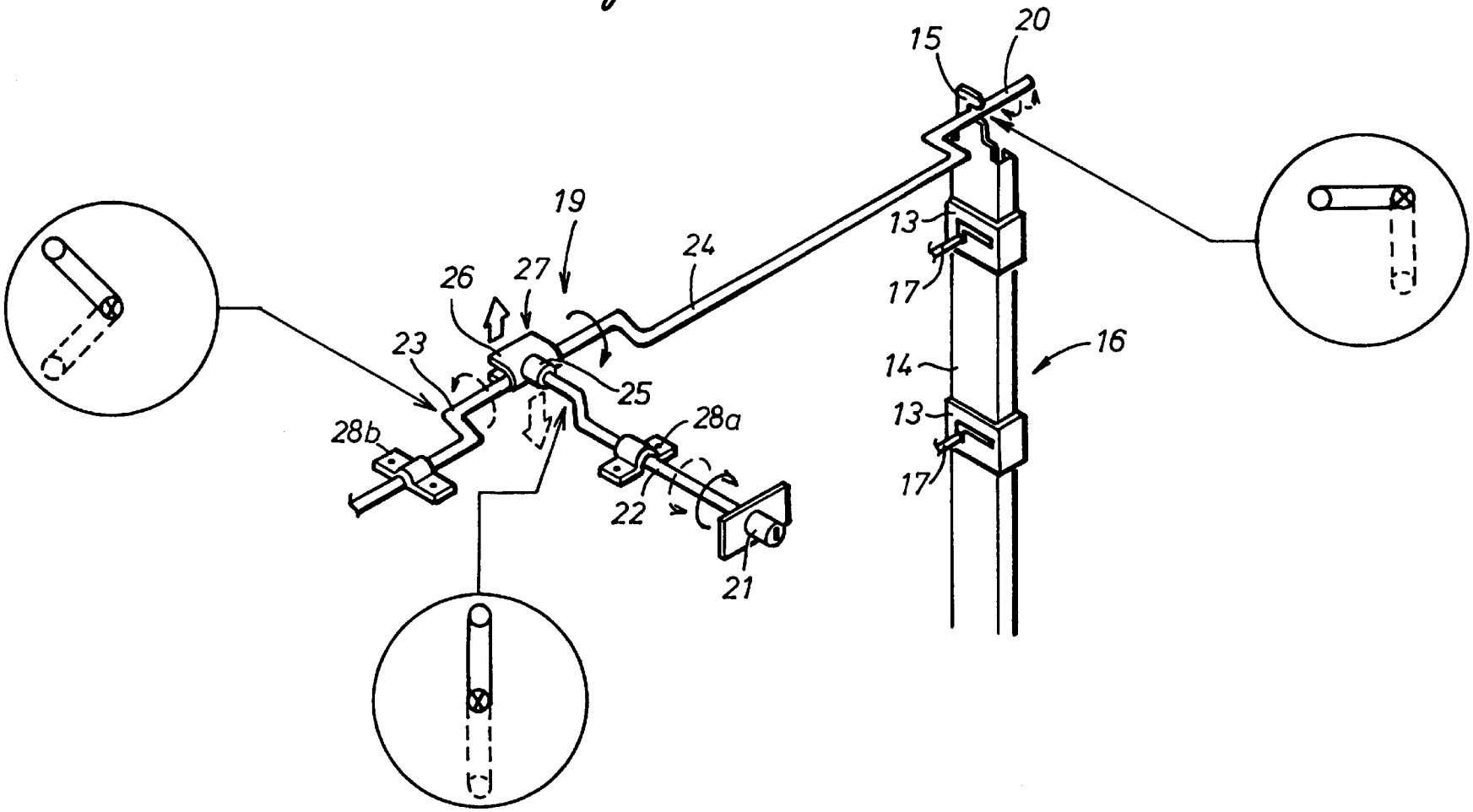
FIG. 3 is a perspective view showing the actuating mechanism for locking the drawers.
Figure 4:
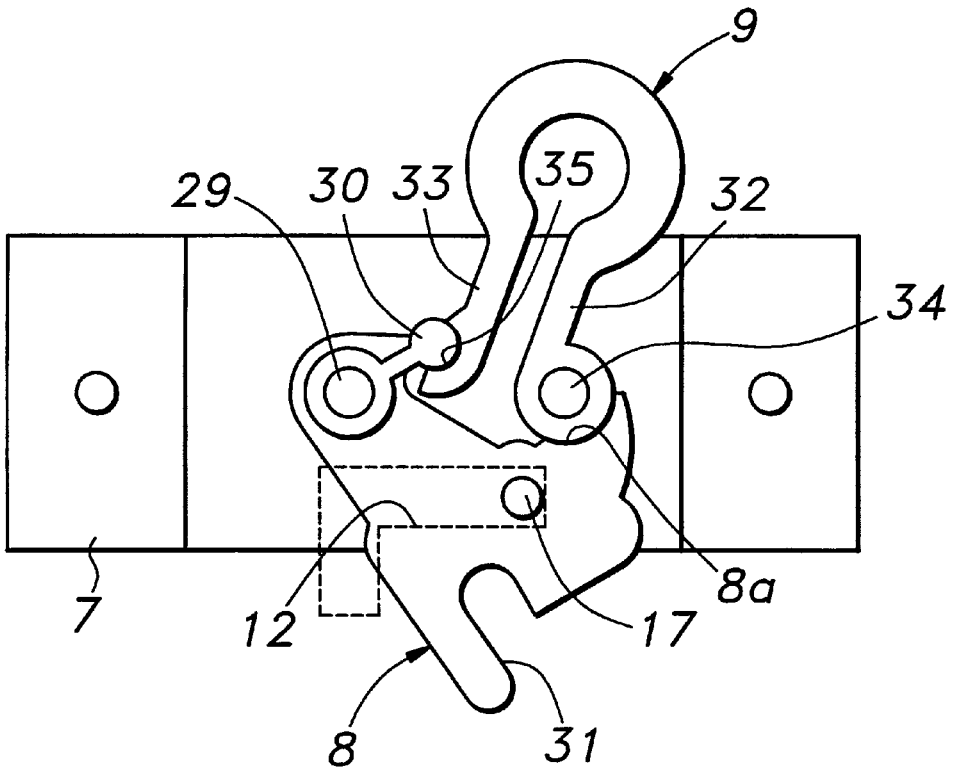
FIG. 4 is an enlarged front view of the latch member and the latch spring.

Thus, in the state illustrated in FIG. 3, the cranked free end 20 of the crankshaft 24 is at a relatively raised position, and the moveable member 14 is accordingly at a raised position, thereby causing the pins 17 to be received in the vertical legs of the control slots 12. Therefore, the latch members 8 are prevented from turning, and the drawers 1 are locked up in a closed state. When a key is fitted into the key cylinder 21 and is turned 180 degrees in counter-clockwise direction as indicated by the dotted arrow, the cranked free end of the drive shaft 22 moves from a highest position to a lowest position, causing the cranked intermediate part 23 of the crankshaft 24 to turn 90 degrees via the sleeve portion 26. This movement is transmitted to the cranked free end 20 of the crankshaft 24, and causes the moveable member 14 to be lowered via the hook portion 15. This causes all the drawers 1 to be released by virtue of the pins 17 being allowed to travel in the horizontal legs of the corresponding L-shaped slots 12 so as to allow the rotational movement of the latch member 8.

Conversely, when the key cylinder 21 along with the drive shaft 22 is turned in the clockwise direction as indicated by the solid arrow by 180 degrees, the resulting upward movement of the coupling member 27 causes the cranked intermediate portion 23 of the crankshaft 24 to turn 90 degrees as indicated in the drawing, thereby causing the moveable member 14 to be raised. This causes all the drawers to be locked up by virtue of the pins 17 being received in the vertical legs of the corresponding L-shaped slots 12 so as to prevent the rotational movement of the latch member 8.

Thus, the described arrangement allows all the drawers to be selectively locked up simply by turning the key cylinder 21 in either direction.

As described earlier, the latch member 8 is pivotally supported by the pivot shaft 29 which integrally projects from the latch mounting plate 7. The latch member 8 is in turn provided with an engagement projection 30 adjacent to the pivot shaft 29, the laterally extending pin 17 which is received in the control slot 12, and a latch slot 31 for receiving the striker pin 4 of the corresponding drawer 1.

The latch spring 9 includes a pair of resilient legs 32 and 33 which are adapted to produce a spring force as they are moved toward or away from each other. A free end of one of the legs 32 is engaged by a pivot shaft 34 extending from the latch mounting plate 7 while a free end of the other leg 33 is provided with a recess 35 for snugly receiving a free end of the engagement projection 30 of the latch member 8. The latch spring 9 is made of resilient and durable material such as PBT (polybutylnene terephthalate) which urges the two legs away from each other in the installed state.

The latch member 8 is provided with an arcuate recess 8*a* which is adapted to snugly receive a free end of one of the legs 32 of the latch spring 9 (rest condition) which is pivotally attached to a fixed portion. This facilitates the assembling of the latch spring 9. The latch spring 9 is joined with the latch member 8, and may be simultaneously fitted onto the respective pivot shafts 29 and 34 without being interfered by the resilient force of the latch spring 9 because the latch spring can be retained between the arcuate recess 8*a* of the latch member 8 and the engagement projection 30.

The latch member 8 can take a release position (A) and an engagement position (C) which are defined on either side of a neutral position (B) by the action of the striker pin 4. For instance, when the drawer 1 is in the open state, the latch member 8 is at the release position (A). When the drawer 1 is closed from this state, the striker pin 4 is engaged by the engagement slot 31, and as the drawer is fully closed, turns the latch member 8 around the pivot shaft 29 beyond the neutral position (B). The latch spring initially urges the latch member 8 in the direction to oppose the pressure from the striker pin 4. However, once the neutral position is passed, the resilient force of the latch spring 9 assists the inward movement of the striker pin 4 along with the drawer 1. The engagement slot 31 positively retains the striker pin 4 during this phase. The reversing of the direction of the resilient force acting on the latch member 8 is accomplished because the distance between the engagement projection 30 and the pivot shaft 34 diminishes as the latch member 8 turns from the release position (A) to the neutral position (B), and then increases as the latch member 8 turns from the neutral position (B) to the engagement position (C).

Thus, the latch spring 9 not only reduces the impact of fully closing the drawer but also resiliently retains the drawer so that the drawer is prevented from being bounced back from its fully closed position even when the drawer is closed in a relatively forcible manner. Once the drawer is fully closed, the striker pin 4 is engaged in the engagement slot 31 so that an inadvertent opening of the drawer can be avoided even when the cabinet is subject to an impact or vibration.

The drawer can be pulled out to an open position by overcoming the retaining force of the latch spring 9. This corresponds to the movement of the striker pin 4 from the engagement position (C) to the neutral position (B). Once the neutral position is passed, the resilient force of the latch spring starts assisting the outward movement of the drawer.

The latch spring 9 may consist of a planar sheet spring cut into a prescribed shape, and may have a relatively small thickness so that the necessary mounting space for the latch spring can be minimized. Further, the spring may be made of synthetic resin which would not rust and is highly durable.

The above described latch mechanism is typically provided on the inner surface of each side panel of the cabinet adjacent to the location of the corresponding striker pin when the drawer is fully closed. The same number of pairs of such latch mechanisms as the number of the drawers may be provided in each cabinet, and they may be adapted to be locked up with a single centralized locking mechanism as described in the following with reference to FIG. 6.

Figure 5:
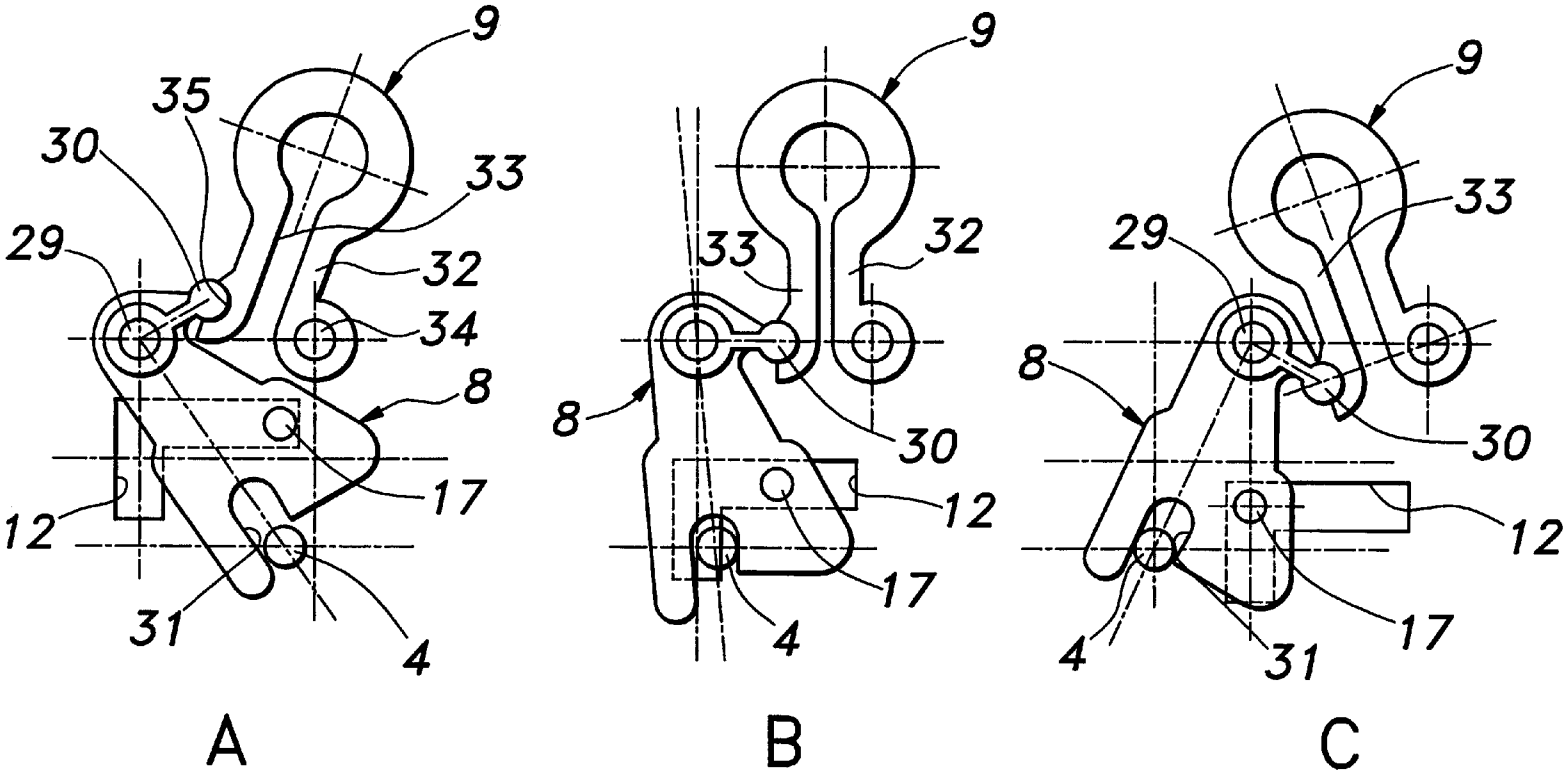
FIGS. 5A–5C show three different positions of the latch member and the latch spring.
Figure 6:
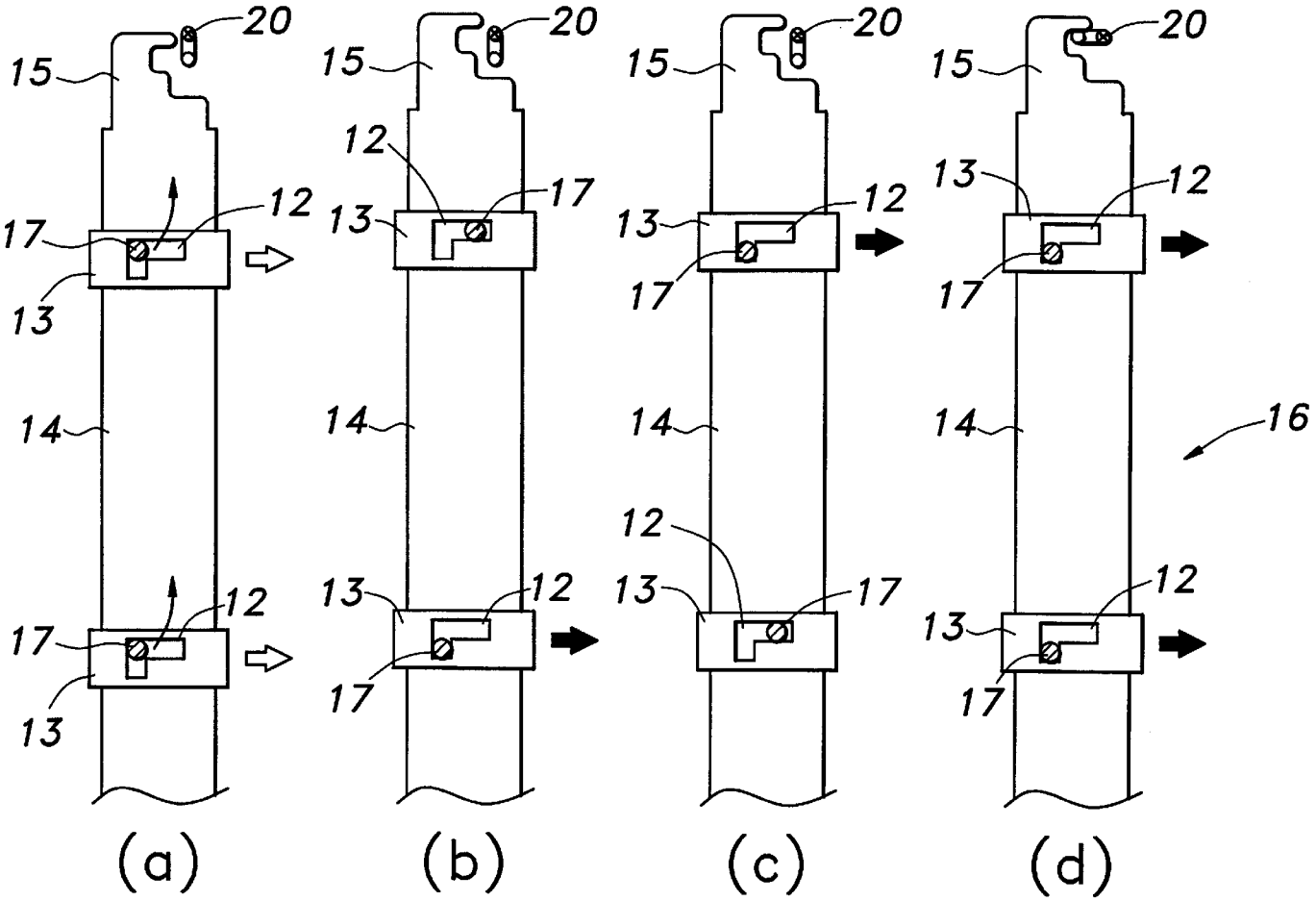
FIGS. 6*a*–6*d* show four different states of the moveable member in relation with the latch pin.

Now it is assumed that the centralized lock is released, and the drawers are all fully closed. Thus, each latch mechanism is at the engagement position (C) of FIG. 5 with the latch pin 17 located near the rear end of the horizontal leg of the control slot 12, and the hook portion 15 is disengaged from the cranked free end 20 of a crankshaft 24 as illustrated in FIG. 6(*a*). In other words, the moveable member 14 is at its lowered position. Therefore, the moveable member 16 is supported by the latch pins 17 received in the control slots 12. If any one of the drawer 1 is pulled out, and the corresponding latch member 8 is turned as indicated by arrows in FIG. 6(*a*), it causes the moveable member 14 to be lifted, and permits the drawer to be pulled out unhindered other than the damping action accomplished by the latch member 8 and the latch spring 9.

As the drawer 1 is further pulled out, and the corresponding latch pin 17 advances in the corresponding horizontal leg of the control slot 12, the pin 17 which undergoes an arcuate movement pushes up the moveable member 14 so that the latch pins 17 of the other drawers travel relatively downward in the vertical legs of the corresponding control slots 12 so that the remaining drawers are thereby prevented from being opened. FIG. 6(*b*) shows the upper drawer is being pulled out, thereby locking up the lower drawer, and FIG. 6(*c*) shows the lower drawer is being pulled out, thereby locking up the upper drawer. Thus, two or more of the drawers cannot be opened at the same time, and the problems associated with the shifting of the mass of the drawers to one side can be avoided.

When the key cylinder 21 is turned with all the drawers fully closed, the cranked free end 20 of the crankshaft 24 lifts the moveable member 14 via the hook portion 15 so that the latch pins 17 are moved to the lower ends of the vertical legs of the corresponding control slots 12, and the drawers are thereby all locked up.

Thus according to the drawer control of the present invention, the central locking mechanism, the drawer interlocking mechanism and the damping mechanism are incorporated into a single integrated mechanism so that various advantages for both manufacture and use can be achieved. The integration of the three individual mechanisms can reduce the total number of component parts, and the efforts required to assemble the component parts. Because the operation of each of the mechanisms is optimally synchronized with the others owing to the integration of the three individual mechanisms, it is possible to maximize assembling precision, and to ensure a favorable and reliable operation at all times.

Although the present invention has been described in terms of a preferred embodiment thereof, it is obvious to a person skilled in the art that various alterations and modifications are possible without departing from the scope of the present invention which is set forth in the appended claims.

What I claim is:

1. A drawer control for a file cabinet which includes a cabinet main body, and a plurality of vertically stacked drawers, said drawer control comprising:

a striker pin secured to each of said drawers;

a latch member pivotally attached to an inner surface of said cabinet main body and including a latch slot adapted to receive said striker pin, said latch member being pivotable between an engagement position for engaging said striker pin in said latch slot when said drawer is adjacent to a fully closed position thereof, and a release position for receiving and releasing said striker pin in and from said latch slot;

a latch spring coupled to said latch member to provide a pivotal bias of said latch member toward said engagement position when said latch member is between said engagement position and an intermediate neutral position, and toward said release position when said latch member is between said intermediate neutral position and said release position;

a moveable member engaged with the latch member and moveable between a lock position for locking said latch member at said engagement position, and an unlock position for permitting movement of said latch member from said engagement position to said release position; and a lock member coupled to said moveable member for moving said moveable member between said lock position and said unlock position;

said latch member being provided with an actuating portion coupled to said moveable member for moving said moveable member from said unlock position to said lock position when said latch member has pivoted from said engagement position to said release position so as to allow only one of said drawers to be opened at a time, wherein said moveable member is provided with a control slot for said latch member, said control slot being provided with a first leg and a second leg, and said latch member is provided with a laterally extending pin which is received in said control slot, said laterally extending pin being engaged by said first leg of said control slot so as to prevent movement of said latch member when said moveable member is at said lock position.

2. A drawer control for a file cabinet according to claim 1, wherein said laterally extending pin is adapted to move along said second leg of said control slot as said latch member pivots from said engagement position to said release position and said laterally extending pin moves along an arcuate path so as to move said moveable member into said lock position.

3. A drawer control for a file cabinet according to claim 2, wherein said control slot consists of an L-shaped slot, and said first and second legs are defined by vertical and horizontal legs of said L-shaped slot.

4. A drawer control for a file cabinet which includes a cabinet main body, and a plurality of vertically stacked drawers, said drawer control comprising:

a striker pin secured to each of said drawers;

a latch member pivotally attached to an inner surface of said cabinet main body and including a latch slot adapted to receive said striker pin, said latch member being pivotable between an engagement position for engaging said striker pin in said latch slot when said drawer is adjacent to a fully closed position thereof, and a release position for receiving and releasing said striker pin in and from said latch slot;

a latch spring coupled to said latch member to provide a pivotal bias of said latch member toward said engagement position when said latch member is between said engagement position and an intermediate neutral position, and toward said release position when said latch member is between said intermediate neutral position and said release position;

a moveable member engaged with the latch members of the respective drawers, and moveable between a lock position for locking said latch member at said engagement position, and an unlock position for permitting movement of said latch member from said engagement position to said release position; and a lock member coupled to said moveable member for moving said moveable member between said lock position and said unlock position for selectively and simultaneously locking all of said drawers;

said latch member being provided with an actuating portion engaging said moveable member so as to move said moveable member from said unlock position to said lock position when said latch member has pivoted from said engagement position to said release position so as to allow only one of said drawers to be opened at a time, wherein said latch spring includes a pair of legs which are pivotally attached to a fixed part of the cabinet main body and a part of said latch member so as to apply a biasing force which tends to move said two legs away from each other as said latch is pivoted.

5. A drawer control for a file cabinet according to claim 4, wherein said latch member is provided with an arcuate recess for resiliently interposing said latch spring between a point of pivotal attachment of said latch spring to said latch member and said arcuate recess for retaining said latch spring onto said latch member when pivotally attaching both said latch member and said latch spring to said fixed part.

6. A drawer control for a file cabinet according to claim 4, wherein said laterally extending pin is adapted to move along said second leg of said control slot as said latch member pivots from said engagement position to said release position and said laterally extending pin moves along an arcuate path so as to move said moveable member into said lock position.

7. A drawer control for a file cabinet according to claim 6, wherein said control slot consists of an L-shaped slot, and said first and second legs are defined by vertical and horizontal legs of said L-shaped slot.

8. A drawer control for a file cabinet according to claim 4, wherein said latch member is provided with an arcuate recess for resiliently interposing said latch spring between a point of pivotal attachment of said latch spring to said latch member and said arcuate recess for retaining said latch spring onto said latch member when pivotally attaching both said latch member and said latch spring to said fixed part.

9. A drawer control for a file cabinet which includes a cabinet main body, and a plurality of vertically stacked drawers, said drawer control comprising:

a striker pin secured to each of said drawers;

a latch member pivotally attached to an inner surface of said cabinet main body and including a latch slot adapted to receive said striker pin, said latch member being pivotable between an engagement position for engaging said striker pin in said latch slot when said drawer is adjacent to a fully closed position thereof, and a release position for receiving and releasing said striker pin in and from said latch slot;

a latch spring coupled to said latch member to provide a pivotal bias of said latch member and said striker pin toward said engagement position when said latch member is between said engagement position and an intermediate neutral position, and toward said release position when said latch member is between said intermediate neutral position and said release position; and a moveable member engaged with the latch members of the respective drawers, and moveable between a lock position for locking said latch member at said engagement position, and an unlock position for permitting movement of said latch member from said engagement position to said release position, wherein said moveable member is provided with a control slot for said latch member, said control slot being provided with a first leg and a second leg, and said latch member is provided with a laterally extending pin which is received in said control slot, said laterally extending pin being engaged by said first leg of said control slot so as to prevent movement of said latch member when said moveable member is at said lock position.

10. A drawer control for a file cabinet according to claim 9, wherein said laterally extending pin is adapted to move along said second leg of said control slot as said latch member pivots from said engagement position to said release position and said laterally extending pin moves along an arcuate path so as to move said moveable member into said lock position.

11. A drawer control for a file cabinet according to claim 10, wherein said control slot consists of an L-shaped slot, and said first and second legs are defined by vertical and horizontal legs of said L-shaped slot.

12. A drawer control for a file cabinet which includes a cabinet main body, and a plurality of vertically stacked drawers, said drawer control comprising:

a striker pin secured to each of said drawers;

a latch member pivotally attached to an inner surface of said cabinet main body and including a latch slot adapted to receive said striker pin, said latch member being pivotable between an engagement position for engaging said striker pin in said latch slot when said drawer is adjacent to a fully closed position thereof, and a release position for receiving and releasing said striker pin in and from said latch slot;

a latch spring coupled to said latch member to provide a pivotal bias of said latch member and said striker pin toward said engagement position when said latch member is between said engagement position and an intermediate neutral position, and toward said release position when said latch member is between said intermediate neutral position and said release position; and a moveable member engaged with the latch members of the respective drawers, and moveable between a lock position for locking said latch member at said engagement position, and an unlock position for permitting movement of said latch member from said engagement position to said release position, wherein said latch spring includes a pair of legs which are pivotally attached to a fixed part of the cabinet main body and a part of said latch member so as to apply a biasing force which tends to move said two legs away from each other as said latch is pivoted.

13. A drawer control for a file cabinet according to claim 12, wherein said latch member is provided with an arcuate recess for resiliently interposing said latch spring between a point of pivotal attachment of said latch spring to said latch member and said arcuate recess for retaining said latch spring onto said latch member when pivotally attaching both said latch member and said latch spring to said fixed part.

* * * * *